United States Patent [19]

Dürr et al.

[11] 4,108,297

[45] Aug. 22, 1978

[54] GUIDE FOR A PRINTING HEAD OF A PRINTING DEVICE

[75] Inventors: Heinrich Dürr, Wilnsdorf-Niederdielfen; Lothar Haubrich, Eiserfeld, both of Fed. Rep. of Germany

[73] Assignee: U.S. Philips Corporation, New York, N.Y.

[21] Appl. No.: 785,880

[22] Filed: Apr. 8, 1977

[30] Foreign Application Priority Data

Apr. 24, 1976 [DE] Fed. Rep. of Germany ..... 2618001

[51] Int. Cl.[2] ..... B41J 29/02

[52] U.S. Cl. ..... 400/354; 400/691

[58] Field of Search ..... 197/1 R, 16, 18, 55, 197/82, 65, 186 R, 186 A, 186 B

[56] References Cited

U.S. PATENT DOCUMENTS

| | | | |
|---|---|---|---|
| 3,442,365 | 5/1969 | Ragland et al. | 197/55 X |
| 3,605,977 | 9/1971 | Janz et al. | 197/55 X |
| 3,910,395 | 10/1975 | Colglazier et al. | 197/1 R |
| 3,990,564 | 11/1976 | Crump et al. | 197/1 R X |

*Primary Examiner*—Paul T. Sewell

*Attorney, Agent, or Firm*—Frank R. Trifari; Robert S. Smith

[57] ABSTRACT

A guide for limiting displacement of a printing head parallel to the printing direction in a printing device. The printing head is displaceable along two parallel guide rods which are detachably connected on a supporting beam which extends parallel to the guide rods. The supporting beam is detachably connected to two side plates which extend transversely of the beam and which are provided with projections which fit in recesses provided at each of the end faces of the beam. The guide provides a mechanically stable construction that is readily detachable.

4 Claims, 5 Drawing Figures

GUIDE FOR A PRINTING HEAD OF A PRINTING DEVICE

Figure 1:
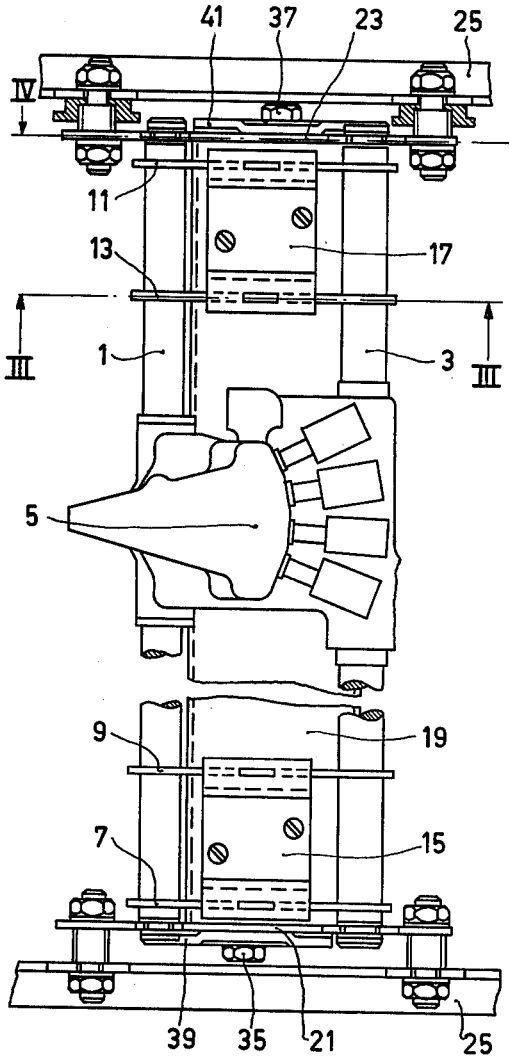

The invention relates to a guide for the displacement of a printing head parallel to the printing direction in a printing device. The printing head is displaceable along two parallel round guide rods which are secured in the frame of the printing device near both their ends by means of side plates which extend transversely of the guide rods.

Comparatively long guide rods are often required for the linear guiding of a printing head of a printing device. Long guide rods of this kind occur notably in office machines utilising two printing heads which operate either simultaneously or individually and which are displaceable along different parts of a single guide. The guide rods may be secured to the frame of the printing device directly as well as indirectly by means of side plates which extend transversely of the guide rods. Guides of printing heads impose a problem in that a compromise must be found between a construction having a comparatively low weight and a comparatively high resistance against bending. Bending may be due to the weight of the printing head itself as well as to reaction forces on the guide rods. These reaction forces occur when use is made of a printing head comprising mechanical impact elements such as, for example, the printing pins of a matrix printer. Bending or other movement of the guide rods causes curved lines on the record carrier and differences in contrast of the characters printed. Differences in contrast of this kind are caused by a non-constant distance between the ends of the printing pins and the record carrier. The paralelity of the guide rods is, therefore, of essential importance. Furthermore, it is very desirable to mount not only the printing head to be detachable on the guide rods (as is usually the case), but also to connect the guide rods themselves to be readily detachable in the frame of the printing device. In the case of wear, it must be simply possible to quickly replace the printing head with the guide rods as one unit as well as to replace the printing head and the guide rods separately. Finally, the guide rods must be accurately positioned as a unit relative to the printing direction in order to ensure a constant distance between printing head and record carrier.

The invention has for its object to provide a guide for a printing head having guide rods which are arranged accurately parallel to the printing direction and having a comparatively low weight and a high mechanical stability.

To this end, a guide in accordance with the invention is characterized in that the guide rods are connected to the side plates by means of a supporting beam which extends parallel to the printing direction, the supporting beam is provided on each of its end faces with recesses to fit projections provided on the side plates, and also with a threaded hole which is intended for the connection of the relevant side plate to the supporting beam by means of a bolt screwed through a hole in the side plate.

The invention will be described in detail hereinafter with reference to the accompanying diagrammatic drawing.

Figure 2:
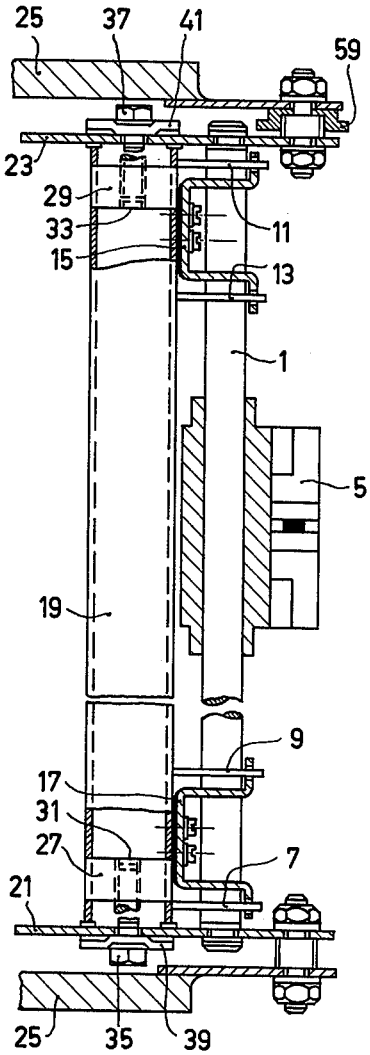
Figure 3:
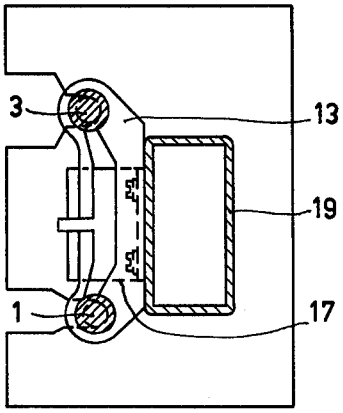
Figure 4:
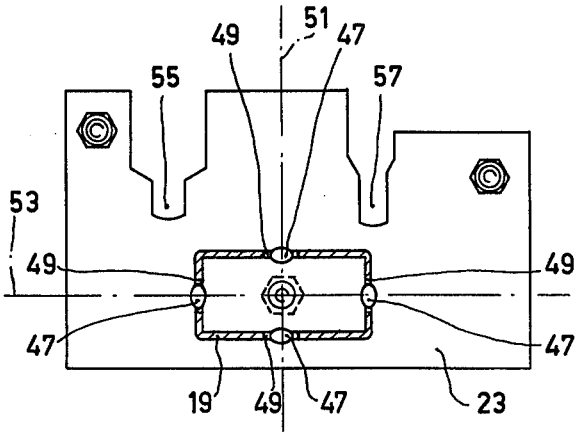
Figure 5:
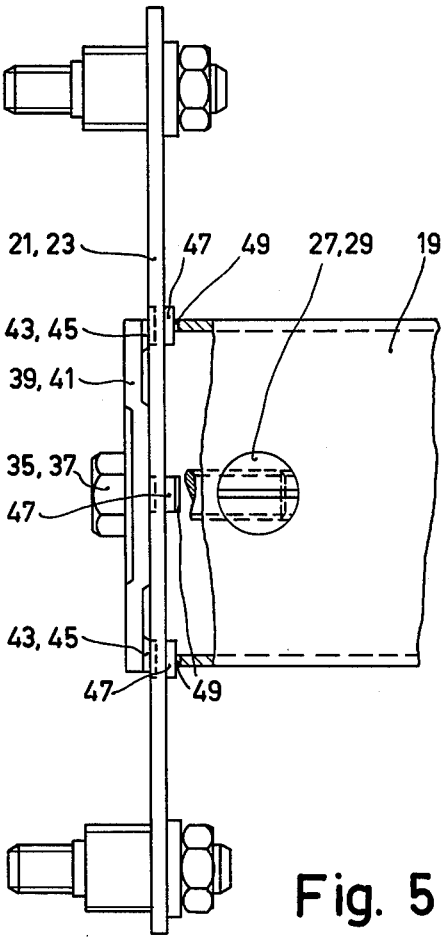

FIG. 1 is a plan view of a printing head with a guide in accordance with the invention, FIG. 2 is a longitudinal sectional view of the printing head with guide shown in FIG. 1, FIG. 3 is a cross sectional view at an increased scale, taken along the line III—III, of the guide shown in FIG. 1, FIG. 4 is a cross-sectional view at an increased scale, taken along the line IV—IV of FIG. 1, FIG. 5 shows the connection of the supporting beam to the side plates at an increased scale.

The part of a printing device which is shown in the FIGS. 1 and 2 and which is used, for example, in bookkeeping equipment, comprises two mutually parallel, preferably round guide rods 1 and 3 along which a printing head 5 can be displaced. The printing head 5, a so-termed matrix printing head with printing pins, is detachably mounted on the guide rods 1 and 3 in a commonly used manner. The guide rods extend parallel to the printing direction and an anvil which is not relevant in this context.

The guide rods 1 and 3 are maintained at a fixed distance from each other by clamps 7, 9, 11 and 13. The pair of clamps 7 and 9 is situated near the right end of the rods, while the pair of clamps 11 and 13 is situated near the left end of the rods (see the FIGS. 1 and 3). The distance between two clamps of a pair is preferably chosen to be equal to one twentieth part of the overall length of the guide rods. For a length of 100 cm of the rods, commonly used for bookkeeping equipment, this means that the distance between the two clamps of a pair amounts to 5 cm. The described length ratio ensures optimum resistance against bending of the guide rods. Obviously, the clamps 7, 9, 11 and 13 are symmetrically arranged relative to the centre of the guide rods. The clamps 7, 9 and 11, 13 are clamped around the guide rods 1 and 3 by means of clamping brackets 15 and 17 having a U-shaped section. The clamping brackets 15 and 17 are screwed onto a supporting beam 19 for this purpose. The construction of the clamps 7, 9, 11, 13 and the clamping brackets 15 and 17 forms the subject of German Patent Application No. P 2617562.2.

The longitudinal direction of the supporting beam 19 is parallel to the guide rods 1 and 3. Use is preferably made of a supporting beam having a rectangular, hollow profile. The beam 19 is secured in a frame 25 by way of two side plates 21 and 23 which extend transversely of the longitudinal direction of the beam. To this end, the beam 19 is provided near both its ends with bolts 27 and 29 (see FIG. 2). The bolts 27 and 29 are screwed into the beam and the longitudinal direction of each extends transversely of the longitudinal direction of the beam. Instead of bolts, use can also be made of short shafts or cubes which are welded in the supporting beam. The bolts 27 and 29 are provided with threaded holes 31 and 33 in which bolts 35 and 37, inserted through openings in the side plates 21 and 23, are screwed. Between the heads of the bolts 35 and 37 there are provided so-termed clamping plates (reinforcement plates) 39 and 41 which prevent warping of the comparatively thin side plates 21 and 23 by the tightening of the bolts 35 and 37. The clamping plates, preferably having a rectangular shape, are provided with ridges 43 and 45 which are situated opposite the edges of the end faces of the supporting beam 19. The clamping force of the bolts 35 and 37 is optimally transferred, via these ridges, to the supporting beam 19 (see FIG. 5). The side plates 21 and 23 are provided with four raised portions 47 (projections) which fit in four recesses 49 provided in the end edges at each end of the supporting beam 19 (see also FIG. 4). The four recesses 49 are symmetrically situated relative to the transverse axes 51 and 53 of the supporting beam. It will be obvious that in minimum number of two recesses is required for each end of the supporting beam. The side plates 21 and 23 are provided with recesses 55 and 57 which serve for additional journalling of the ends of the guide rods 1 and 3 (see FIG. 4).

The assembly formed by the supporting beam, connected to the side plates, and the guide rods mounted on the supporting beam is preferably arranged to be detachable and adjustable in the frame 25. In the present embodiment, the side plates 21 and 23 are screwed to the frame via adjusting nuts 59 which are situated between the frame and the side plate. By means of adjusting nuts of this kind, the said assembly can be aligned relative to the frame so that the guide rods of the printing head extend accurately parallel to the printing direction.

The guide described in the foregoing is preferably used in combination with a guide for the guide rods as described in the said German Patent Application. However, it is alternatively possible to secure the guide rods on the supporting beam construction in accordance with the invention in a manner other than described in the said Patent Application.

What is claimed is:

1. A printing device which comprises: a frame; a printing head; and a guide for limiting displacement of said printing head parallel to a predetermined printing direction, said guide comprising two parallel round guide rods, first and second guide plates carried on said frame proximate both ends of said guide bar of said side plates extending transversely of said guide rods, said guide rods being connected to the side plates by means of a supporting beam which extends parallel to the printing direction, said side plates including a plurality of projections, said supporting beam being provided on each of its end faces with (1) recesses dimensioned and configured to cooperate with said projections on said side plates, and also with (2) a threaded hole at each end thereof which extends longitudinally, said guide further including a first and second bolts respectively coupling said first and second side plates to said threaded holes in said supporting beam.

2. A guide as claimed in claim 1 wherein said supporting beam further includes an additional bolt which extends transversely through said supporting beam and said threaded holes are disposed in said additional bolt.

3. A guide as claimed in claim 1 further including a first reinforcement plate clamped intermediate said first side plate and the head of said first bolt and a second reinforcement plate clamped intermediate said second side plate and the head of said second bolt.

4. A guide as claimed in claim 3 wherein said supporting beam has a hollow, rectangular cross-section.

* * * * *